US012796766B2

(12) United States Patent
Lübke et al.

(10) Patent No.: US 12,796,766 B2
(45) Date of Patent: Nov. 17, 2026

(54) PROTECTIVE HELMET

(71) Applicant: SCHUBERTH GMBH, Magdeburg (DE)

(72) Inventors: Karsten Lübke, Altenhausen (DE); Michél Schrader, Eilsleben (DE); Michael Jarisch, Erxleben (DE)

(73) Assignee: SCHUBERTH GMBH, Magdeburg (DE)

( * ) Notice: Subject to any disclaimer, the term of this patent is extended or adjusted under 35 U.S.C. 154(b) by 939 days.

(21) Appl. No.: 17/905,710

(22) PCT Filed: Mar. 5, 2021

(86) PCT No.: PCT/EP2021/055605
§ 371 (c)(1),
(2) Date: Sep. 6, 2022

(87) PCT Pub. No.: WO2021/176061
PCT Pub. Date: Sep. 10, 2021

(65) Prior Publication Data

US 2023/0018883 A1 Jan. 19, 2023

(30) Foreign Application Priority Data

Mar. 6, 2020 (DE) ..... 10 2020 106 096.3

(51) Int. Cl.
*A42B 3/00* (2006.01)
*A42B 3/14* (2006.01)

(52) U.S. Cl.
CPC ..... *A42B 3/145* (2013.01)

(58) Field of Classification Search
CPC ..... A42B 3/145; A42B 3/14; A42B 3/142
See application file for complete search history.

(56) References Cited

U.S. PATENT DOCUMENTS 2,926,406 A * 3/1960 Edwards ..... A42B 3/145 2/418
3,214,809 A * 11/1965 Edwards ..... A61F 9/06 2/418

(Continued)

FOREIGN PATENT DOCUMENTS

CN 101611943 A 12/2009
CN 106998842 A 8/2017

(Continued)

OTHER PUBLICATIONS

International Search Report issued Jun. 2, 2021 re: Application No. PCT/EP2021/055605; pp. 1-2, citing: DE 102017108038 A1, U.S. Pat. No. 5,893,174 A, US 2009320186 A1 and U.S. Pat. No. 5,983,405 A.

*Primary Examiner* — Richale L Quinn
(74) *Attorney, Agent, or Firm* — CANTOR COLBURN LLP

(57) ABSTRACT

A protective helmet with an outer shell for distributing impact forces, with a head support ring for placing on a head of a wearer of the protective helmet, and with an adjustment device for adjusting a circumference of the head support ring in order to adapt the latter to the head of the wearer. The adjustment device is guided through an opening of the outer shell so as to be operated from outside the outer shell. The protective helmet is characterized in that the adjustment device is designed to tension a spring device, during the adjustment of the circumference, in such a way that the tension of the spring device acts to transfer the head support ring to a basic circumference.

15 Claims, 6 Drawing Sheets

(56) References Cited

U.S. PATENT DOCUMENTS

| | | | | | |
|---|---|---|---|---|---|
| 5,893,174 | A * | 4/1999 | Primeau | A42B 3/145 | 2/9 |
| 5,983,405 | A * | 11/1999 | Casale | A42B 3/145 | 2/421 |
| 6,425,142 | B2 * | 7/2002 | Sasaki | A42B 3/085 | 2/421 |
| 7,870,617 | B2 * | 1/2011 | Butler | A42B 3/145 | 2/410 |
| 8,056,150 | B2 * | 11/2011 | Stokes | A42B 3/145 | 2/418 |
| 8,156,574 | B2 * | 4/2012 | Stokes | A42B 3/145 | 2/418 |
| 8,336,114 | B1 * | 12/2012 | Lee | A42B 3/145 | 2/9 |
| 9,066,551 | B2 * | 6/2015 | Van Waes | A42B 3/142 | |
| 9,480,293 | B2 * | 11/2016 | Pfanner | A42B 3/142 | |
| 9,622,535 | B2 * | 4/2017 | Windham | A42B 3/145 | |
| 9,797,421 | B2 * | 10/2017 | Gaudillere | A44B 11/08 | |
| 10,420,385 | B2 * | 9/2019 | Lakes | A42B 3/145 | |
| 10,548,363 | B2 * | 2/2020 | Pritz | A42B 3/145 | |
| 11,457,684 | B2 * | 10/2022 | Maloney | A42B 3/145 | |
| 11,700,902 | B2 * | 7/2023 | Roberts | A42B 3/145 | 2/421 |
| 11,700,903 | B2 * | 7/2023 | Ferrari | A42B 3/06 | 2/411 |
| 2009/0320186 | A1 * | 12/2009 | Petzl | A42B 3/145 | 2/417 |
| 2010/0170068 | A1 * | 7/2010 | Musal | A42B 3/145 | 24/68 D |
| 2013/0239303 | A1 * | 9/2013 | Cotterman | A42B 3/324 | 2/417 |
| 2013/0312163 | A1 * | 11/2013 | Van Waes | A42B 3/08 | 2/421 |
| 2014/0033405 | A1 * | 2/2014 | Rogers | A42B 3/08 | 2/418 |
| 2015/0059064 | A1 * | 3/2015 | Klotz | A42B 3/145 | 2/417 |
| 2015/0074876 | A1 * | 3/2015 | Chiang | A42B 3/145 | 2/418 |
| 2015/0107006 | A1 * | 4/2015 | Chen | A42B 3/324 | 2/418 |
| 2016/0051000 | A1 * | 2/2016 | Windham | A42B 3/145 | 2/418 |
| 2016/0262484 | A1 * | 9/2016 | Huh | A42B 3/14 | |
| 2017/0000207 | A1 * | 1/2017 | Hajianpour | A42B 3/281 | |
| 2017/0006951 | A1 * | 1/2017 | Venturini | A42B 3/08 | |
| 2020/0121017 | A1 * | 4/2020 | King | A42B 3/14 | |
| 2021/0153594 | A1 * | 5/2021 | Rogers | A42B 3/085 | |
| 2021/0337910 | A1 * | 11/2021 | Musow | A42B 3/145 | |
| 2021/0337911 | A1 * | 11/2021 | Franke | A42B 3/14 | |
| 2024/0143029 | A1 * | 5/2024 | Weiss | G02B 27/0176 | |

FOREIGN PATENT DOCUMENTS

| | | | |
|---|---|---|---|
| DE | 19745960 | A1 | 4/1999 |
| DE | 102009012450 | A1 | 9/2010 |
| DE | 102017108038 | A1 | 10/2018 |
| DE | 102018103759 | A1 | 8/2019 |
| WO | 2014122247 | A1 | 8/2014 |

* cited by examiner

PROTECTIVE HELMET

TECHNICAL FIELD

The disclosure relates to a protective helmet having an outer shell for distributing impact forces, a head support ring for placing on a head of a wearer of the protective helmet, and an adjustment device for adjusting a circumference of the head support ring for adapting to the head of the wearer.

BACKGROUND

Protective helmets, in particular for use by the police or other emergency services are primarily used to protect the wearer from risks of mechanical injuries. In the same way as with other types of helmets, with protective helmets there is also the need to allow a secure wearing of the helmet for wearers with different head circumferences, in any case in a certain range of circumferences. One difficulty lies in the fact that such an adaptation of the circumference usually requires the adjustment of an interior fitment of the protective helmet which is naturally arranged under the fixed outer shell of the protective helmet. The outer shell makes difficult or prevents access to the interior fitment located thereunder.

The American patent U.S. Pat. No. 7,870,617 B2 from the prior art discloses a sports helmet with an interior fitment whose fit can be adjusted by means of flexible bands. These bands are guided through openings in a rear region of the outer shell and can thus also be adjusted and tied down when the sports helmet is worn. A cover plate is provided which is then fastened from outside to the outer shell to cover the openings and the bands guided therethrough.

A disadvantage of this prior art is that removal of the sports helmet is tedious and time-consuming for the wearer. This is particularly the case when the wearer is to accomplish this alone. As already established, it is appropriate to adapt the interior fitment to the head circumference of the wearer after putting on the helmet. Conversely for removal of the helmet it is expedient to enlarge the circumference of the interior fitment before removal and release the interior fitment from the head of the wearer in this respect. However, with this sports helmet this is only possible with some difficulty since for this the wearer must initially release the cover plate fastened in the rear head area of the outer shell. A reliably fast removal is therefore as good as completed.

SUMMARY

Starting from this prior art, the object of the disclosure is therefore to provide a protective helmet which on the one hand can be adapted to different head circumferences of the wearer whilst the protective helmet is being worn and on the other hand, reliably allows a rapid release of this adaptation by the wearer to remove the protective helmet.

This is achieved by providing a protective helmet having an outer shell for distributing impact forces, a head support ring for placing on a head of a wearer of the protective helmet, and an adjustment device for adjusting a circumference of the head support ring for adapting to the head of the wearer and further providing the adjustment device being guided through at least one opening of the outer shell for operation from outside the outer shell, wherein the adjustment device is adapted to tension a spring device of the protective helmet during adjustment of the circumference such that the tension of the spring device acts to transfer the circumference of the head support ring into a basic circumference.

Essential for the disclosure is the finding that by providing a spring device in the protective helmet, which spring device is tensioned by the adjustment of the head circumference of the protective helmet for the respective wearer in such a manner that it brings about a restoration into the basic position, it is possible for the protective helmet to be removed rapidly even by the wearer alone. Specifically a release mechanism can then be provided, by means of which and the tension of the spring device, the protective helmet can be rapidly transferred into this basic adjustment and therefore the protective helmet can be comfortably removed. Usually the basic adjustment comprises the adjustment for the maximum head circumference so that in this basic adjustment the protective helmet usually sits only loosely on the head of the wearer.

The proposed protective helmet comprises an outer shell for distributing impact forces, a head support ring for placing on a head of a wearer of the protective helmet and an adjustment device for adjusting a circumference of the head support ring for adapting to the head of the wearer, wherein the adjustment device is guided through at least one opening of the outer shell for operation from outside the outer shell. For guidance of the adjustment device through the at least one opening of the outer shell, it is sufficient that only one part of the adjustment device is guided through the at least one opening. Outside the outer shell here means that side of the outer shell which is facing away from the head of the wearer of the protective helmet. The head support ring comprises a fundamentally arbitrary arrangement by means of which the protective helmet is supported at least partially on the head of the wearer and which abuts against a circumference of the head of the wearer.

In particular, the proposed protective helmet can comprise a protective helmet for emergency services. These emergency services can comprise security forces such as police or military and also fire brigades.

The proposed protective helmet is characterized in that the adjustment device is adapted to tension a spring device of the protective helmet during adjustment of the circumference in such a manner that the tension of the spring device acts to transfer the circumference of the head support ring into a basic circumference. In other words, the spring device can be tensioned by actuation of the adjustment device, i.e. by adjusting the circumference of the head support ring, in such a manner that this tension urges the head support ring into a state in which the circumference of the head support ring adopts the basic circumference. Preferably this basic circumference of the head support ring corresponds to a maximum circumference of the head support ring. Then, a reduction of the circumference of the head support ring starting from the maximum circumference produces a tension of the spring device which tension acts in the direction of a return to the maximum circumference. Accordingly, it is preferred that the adjustment device is adapted to reduce the circumference of the head support ring starting from the basic circumference.

Fundamentally, it can be the case that the spring device does not have any pre-tension when the circumference of the head support ring is the same as the basic circumference, wherein the basic circumference therefore in particular corresponds to the maximum circumference. Then therefore only the adjustment of a circumference differing from the basic circumference by the adjustment device generates a pre-tension of the spring device. However, it is preferable that the spring device has a pre-tension when the circumference of the head support ring is the same as the basic circumference. In other words therefore, a pre-tension already exists in the basic state of the head support ring. In this way, it is ensured that the spring device already has a certain pre-tension in the maximum adjustment so that the maximum circumference, independently of friction losses, is also actually reliably achieved. A reduction of the head circumference then therefore not only produces a pre-tension but additionally increases an existing pre-tension.

It can be the case that the at least one opening of the outer shell comprises a plurality of openings of the outer shell. Likewise it can be the case that the at least one opening of the outer shell comprises precisely one opening of the outer shell.

Fundamentally the above adjustment device can be implemented in any manner. A preferred embodiment of the proposed protective helmet is characterized in that the adjustment device has a button for adjusting the circumference by a rotary movement which button can be turned from outside the outer shell. Thus, the rotary actuation to adjust the circumference can be performed from outside the outer shell.

The rotatability from outside the outer shell can be achieved in different ways. In particular, it can be the case that the button is guided through the at least one opening. Another possibility will be explained further hereinafter.

Fundamentally the at least one opening can comprise at least one opening of any type. A further preferred embodiment of the protective helmet according to the disclosure is characterized in that the at least one opening is a bore completely surrounded by the outer shell. In particular it can be the case that the at least one opening consists of at least one bore completely surrounded by the outer shell. A bore is therefore understood as an opening with a closed edge. A bore is therefore in particular not a notch-like incision. Fundamentally, the at least one opening can be arranged at any position of the outer shell. It is preferred however that the at least one opening is arranged on a rear side of the outer shell.

According to a preferred embodiment of the protective helmet according to the disclosure, it is provided that the adjustment device comprises a cable arrangement, wherein the cable arrangement is adapted to apply a pulling actuation to the head support ring for adjusting the circumference. In particular, it can be the case that the cable arrangement is adapted to apply a pulling actuation to the head support ring to reduce the circumference. Preferably the cable arrangement is coupled to the button. Fundamentally the cable arrangement can respond to any type of actuation of the button. Especially it is preferred that the cable arrangement is adapted to apply the pulling actuation to the head support ring for adjusting the circumference by a turning of the button.

According to a further preferred embodiment of the proposed protective helmet, it is provided that the adjustment device is adapted to reduce a cable length of the cable arrangement by winding up the cable arrangement to adjust the circumference of the head support ring. The cable length of the cable arrangement reduced in this way does not comprise the complete length of the cable overall since this fundamentally cannot be varied without separating a part of the cable arrangement. Rather, the cable length to be reduced means the stretched-out cable length. The stretched-out cable length thus comprises that part of the cable arrangement which is not wound up.

A preferred embodiment of the proposed protective helmet is characterized in that the cable arrangement is guided through the at least one opening. Since the cable arrangement usually has a smaller diameter than the button, in this way the at least one opening can be configured to be very small, with the result that the integrity of the outer shell is impaired as little as possible. Here it is further preferred that the button is arranged outside the outer shell.

Fundamentally the head support ring can be configured arbitrarily. A further preferred embodiment of the proposed protective helmet is characterized in that the head support ring has two guide parts which are adapted to be displaced onto one another for adjusting the circumference of the head support ring. In particular, it can be the case that the guide parts form at least partially the circumference of the head support ring. As a result of such a displacement onto one another, the part of the circumference formed by the two guide parts can be adapted since overlapping regions of the guide parts only contribute once to the circumference. It is further preferred that the guide parts are flexible. Flexible guide parts are easier to bring into overlap to form a circumference than rigid guide parts. Likewise, it is preferred that the head support ring has a retaining arrangement for bringing the guide parts past one another. Here it can further be the case that at least one guide part has the retaining arrangement and that the retaining arrangement is adapted for mutual engagement of the guide parts. In this way, it can be ensured that the guide parts remain overlapping.

According to a preferred embodiment of the proposed protective helmet, it is provided that the adjustment device and in particular the cable arrangement is adapted to displace the guide parts onto one another for adjusting the circumference. Such a displacement onto one another is comparatively easy to accomplish by applying a tensile force to the guide parts. Preferably it is also the case that the guide parts have a respective guide opening, wherein the guide openings align at least partially with one another and thereby form a complete opening. The complete opening therefore comprises that opening which corresponds to the overlapping region of both guide openings. Preferably the area of the complete opening is then adapted by adjusting the circumference of the head support ring. It is obvious that the complete opening usually has a larger area, the higher the degree of overlap of the guide parts with the guide openings with respect to one another.

Fundamentally, the spring device can be arbitrarily placed and coupled to the further components of the protective helmet. According to a further preferred embodiment of the protective helmet, it is provided that the spring device is connected to the guide parts and is adapted to apply a tension of the spring device as spring force to the guide parts. In other words, as a result of its connection to the guide parts, the spring device applies a stronger spring force to the guide parts, the more strongly the spring device is tensioned. In particular, it can be the case that the spring device is connected to the guide parts in the region of the respective guide opening.

Fundamentally, the spring device can also comprise a compression spring. It is preferred however that the spring device has a tensile load spring for applying the spring force to the guide parts. Here and hereinafter, the term tensile load spring is to be understood as that device and any component which is adapted to apply a tensile force to an elongation. In particular, the tensile load spring can comprise a screw tension spring or a rubber band. In principle, the spring device can be arranged at any point of the protective helmet. It is preferred that the spring device is arranged substantially at the complete opening. The spring device can thus be positioned in a particularly space-saving manner.

Fundamentally it is possible that the adjustment device acts only on one of the guide parts. A preferred embodiment of the proposed protective helmet is however characterized in that the adjustment device is adapted to apply a substantially oppositely directed tensile force to the guide parts in each case to adjust the circumference of the head support ring. In other words, that tensile force which is applied to one of the two guide parts by the adjustment device is substantially oppositely directed to that tensile force which is applied by the adjustment device to the other of the two guide parts. The tensile force is then therefore applied to the two guide parts.

In particular, it can be the case that the cable arrangement is specially adapted to apply the substantially oppositely directed tensile force in each case to the guide parts. It is also preferred that the spring device is arranged between fastening points of the cable arrangement with the respective guide part.

A further preferred embodiment of the proposed protective helmet is characterized in that the protective helmet has a neck protector to substantially completely cover a neck of the wearer, which neck protector is arranged at a lower edge of the outer shell. The lower edge of the outer shell means that edge which is in the lower direction from the view of a wearer of the protective helmet. It is further preferred that the guide parts are offset in the vertical direction with respect to the outer shell and are arranged in such a manner that the guide parts are covered by the neck protector. In other words, the guide parts are not arranged at the same vertical height as the outer shell. The vertical direction is again defined in relation to a wearer of the protective helmet. In other words, without the neck protector the guide parts would lie so that they would not be covered by the outer shell. This arrangement of the guide parts allows it to act as low as possible on the head of the wearer of the protective helmet and thus ensure a secure hold of the protective helmet.

According to a preferred embodiment of the protective helmet according to the disclosure, it is provided that the adjustment device is adapted to be released by a release actuation so that as a result of its pre-tension the spring device transfers the head support ring into the basic circumference. This then comprises a so-called "quick release" mechanism. Fundamentally, the release actuation can comprise any type of actuation. It is preferred that the release actuation consists of a pressure actuation.

According to a further preferred embodiment of the proposed protective helmet, it is provided that the protective helmet has at least one inner layer part received by the outer shell for damping impact forces and that the head support ring has a main section for fastening the head support ring to the at least one inner layer part. In this case, it can additionally be provided that the head support ring is also fastened directly to the outer shell. Fundamentally the at least one inner layer part can also be arranged adjustably relative to the outer shell. It is preferred however that the at least one inner layer part is arranged in a fixed position with respect to the outer shell. A secure fit of the protective helmet can thus be achieved. In particular, it can be provided that the at least one inner layer part is preferably firmly connected to the outer shell.

A preferred embodiment of the proposed protective helmet is characterized in that the main section is connected to the at least one inner layer part in such a manner that the at least one inner layer part maintains its position with respect to the outer shell upon an adjustment of the circumference of the head support ring. Preferably it holds in particular that the at least one inner guide part maintains its position with respect to the outer shell upon a displacement of the guide parts. It can thus be achieved that the adjustment of the circumference can substantially be achieved without adaptation of the main section.

The above main section can be configured arbitrarily in principle. A further preferred embodiment of the protective helmet according to the disclosure is however characterized in that the main section is substantially T-shaped with two elongate and oppositely running arms for fastening to a respective guide part and with an elongate central part for fastening in a central region of the outer shell. In other words, the arms are used for fastening to the guide parts and the central part is used for fastening preferably to another structure, possibly to an inner layer part. It is further preferred that the arms form a part of the circumference of the head support ring. Fundamentally the arms and the central part can run arbitrarily on the protective helmet. It is preferred that the arms run substantially along a side edge of the outer shell. The term side edge means a side of the outer shell in the transverse direction in relation to a viewing direction of a wearer of the protective helmet. It is also preferred that the central part runs substantially along a crest line CL of the outer shell as shown in FIGS. 3 and 6. The term crest line is also related to a wearer of the protective helmet. This is a centrally running section on the surface of the outer shell with respect to the transverse direction, transversely again relative to the viewing direction of the wearer.

BRIEF DESCRIPTION OF THE DRAWINGS

Further advantageous and preferred embodiments are obtained from the following description with reference to the figures. In the drawing showing merely one exemplary embodiment

DETAILED DESCRIPTION OF THE DRAWINGS

Figure 1:
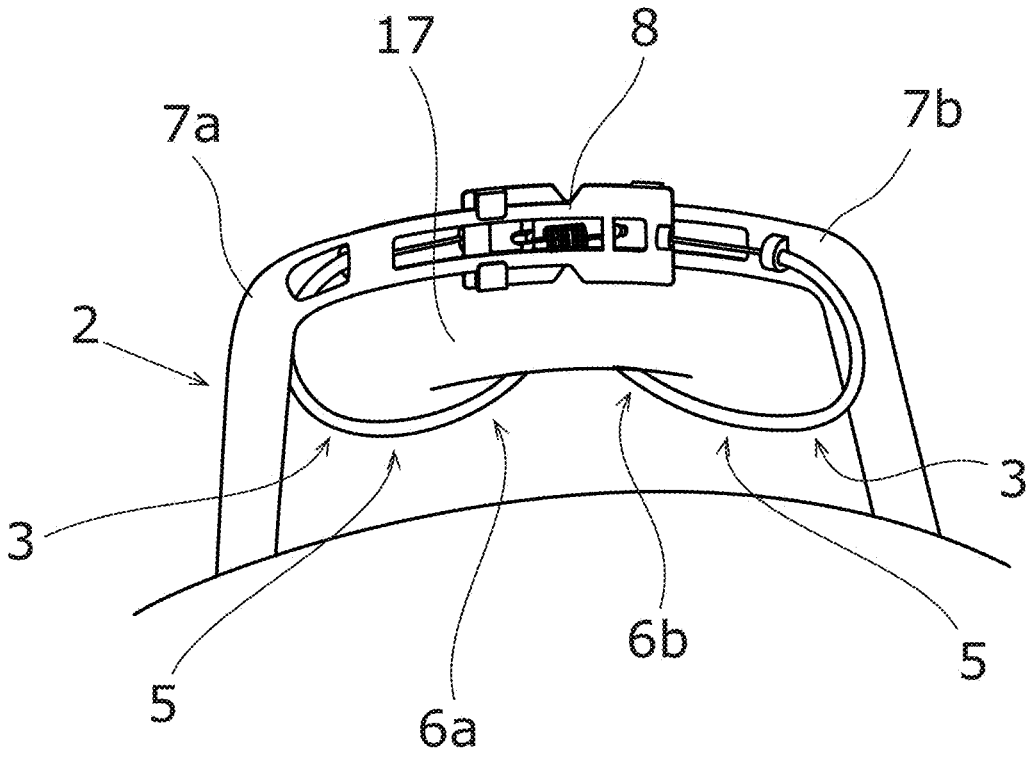
FIG. 1 shows an inner view in detail of an exemplary embodiment of the protective helmet according to the disclosure.
Figure 2:
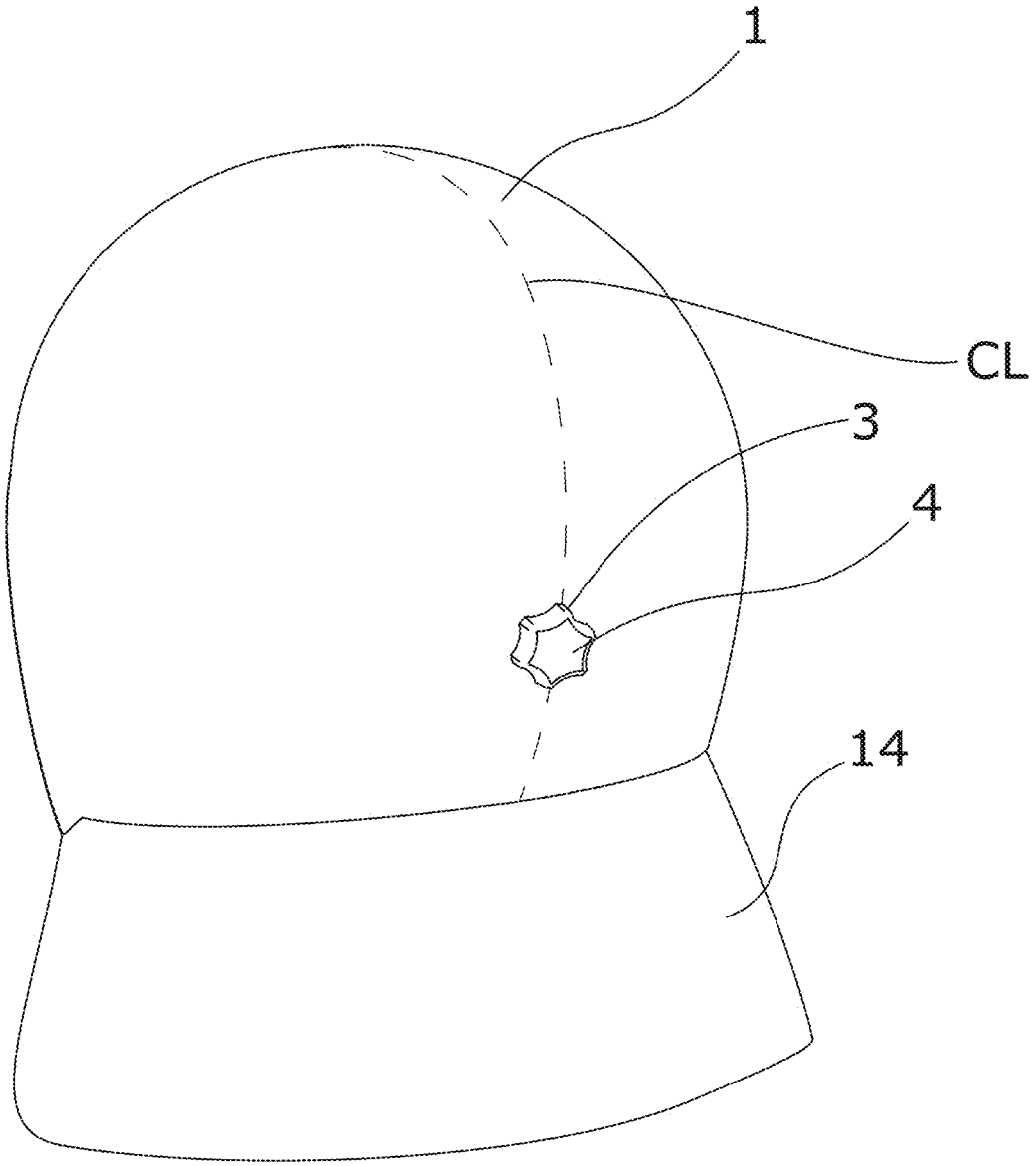
FIG. 2 shows a rear outer view of the protective helmet from FIG. 1.
Figure 3:
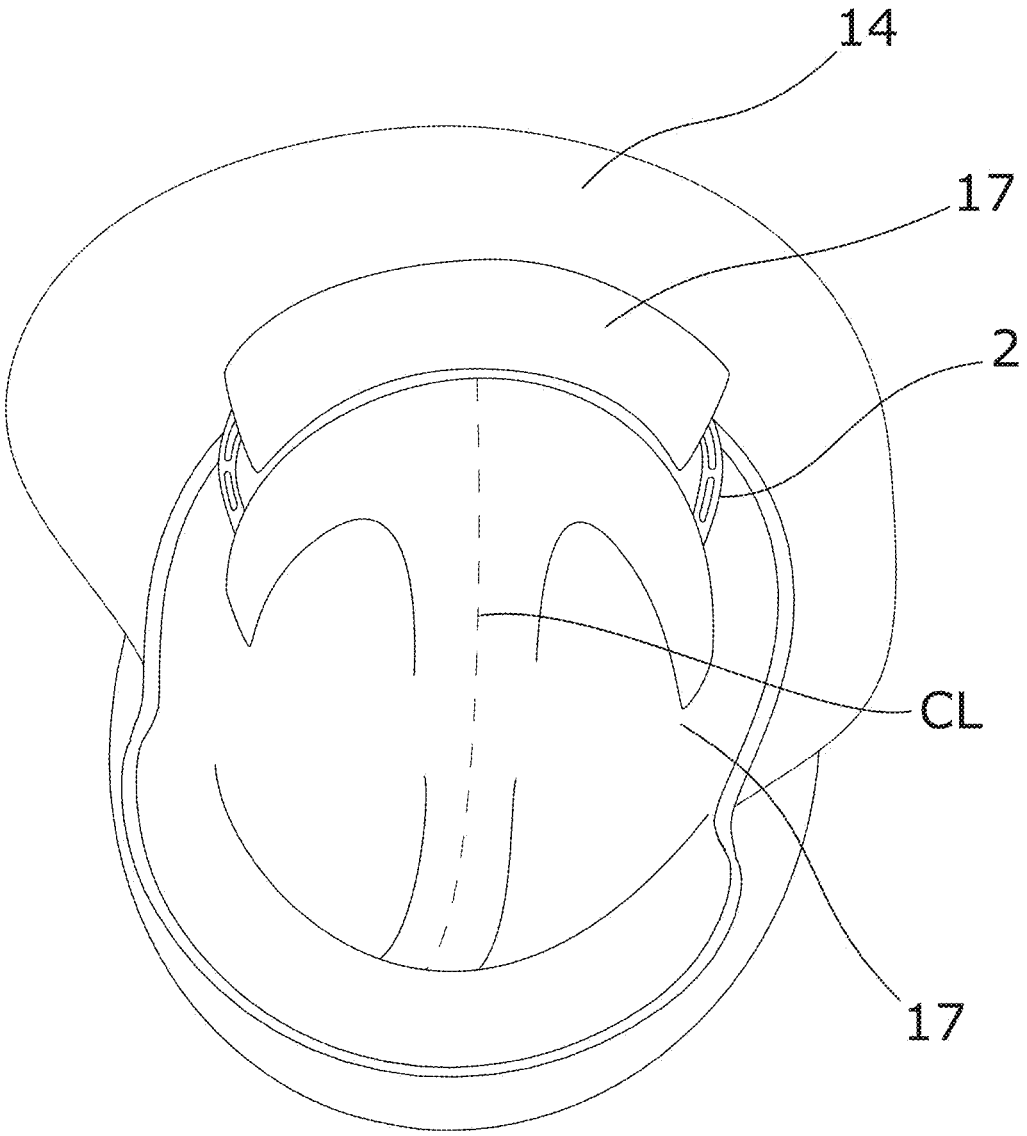
FIG. 3 shows a complete inner view of the protective helmet from FIG. 1.
Figure 6:
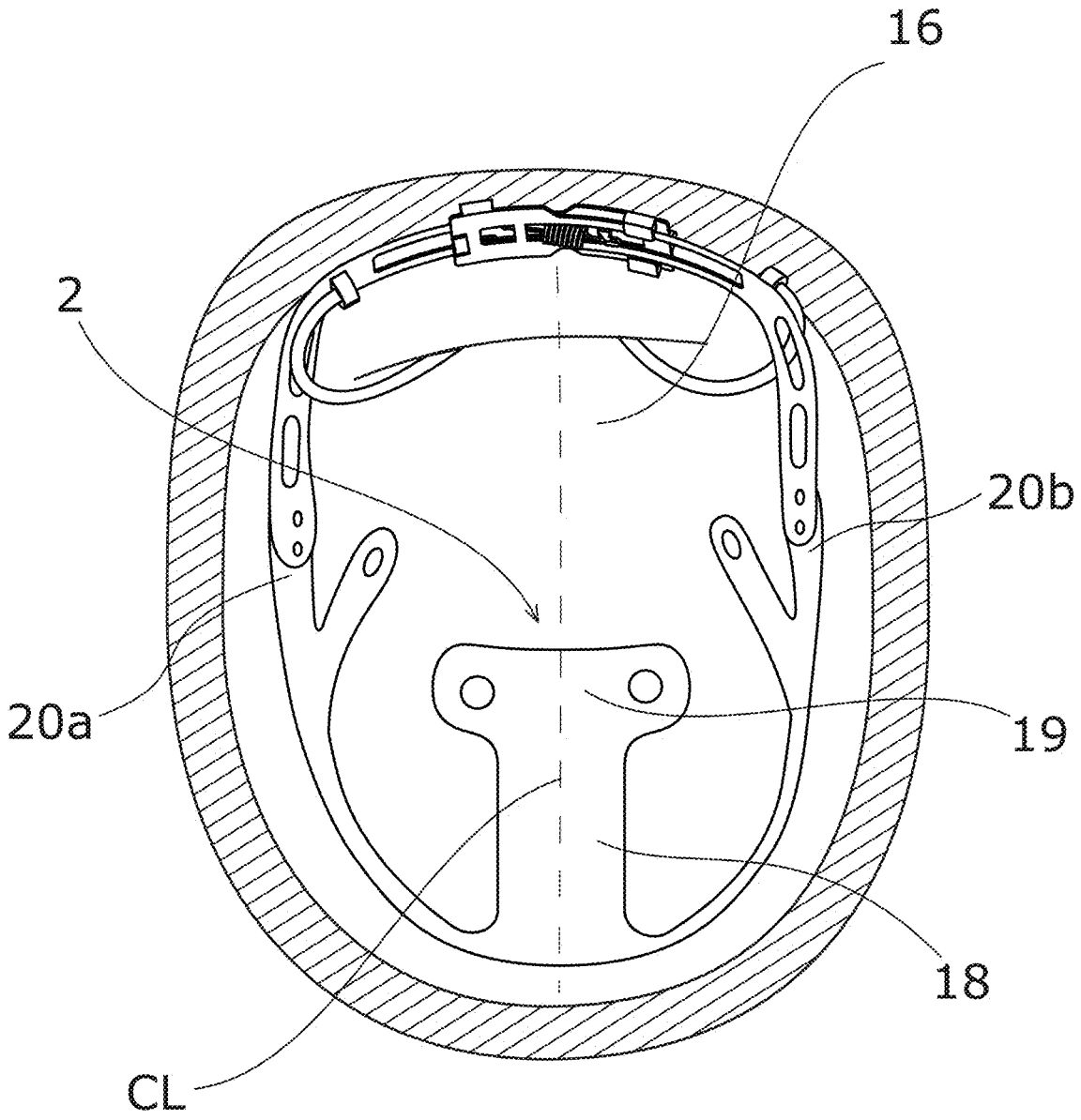

FIG. 1 shows a detail of the protective helmet shown in FIGS. 2 and 3. This is a protective helmet for police forces. The protective helmet has an outer shell 1 which can be clearly seen in FIG. 2 and a head support ring 2 arranged inside the outer shell 1. The head support ring 2 is that part of the protective helmet which is substantially used in particular for the most accurate possible fit of the protective helmet on the head of its wearer. FIG. 6 shows the head support ring 2 in the state arranged inside the outer shell 1.

The protective helmet also has an adjustment device 3 by means of which the circumference of the head support ring 2 can be adapted to the corresponding head circumference of the wearer of the protective helmet.

The adjustment device 3 here consists of a rotatable button 4 which, as shown in FIG. 2, is arranged outside the outer shell 1 and a cable arrangement 5. The cable arrangement 5 comprises a total of two individual cables 6*a, b* which are fastened to the button 4 in such a manner that they can be wound onto the button 4 by means of a turning of the button 4.

The individual cables 6*a, b* are guided into the inside of the outer shell 1 starting from the button 4 through an opening of the outer shell 1 which opening is arranged substantially underneath the button 4. There, as can be seen in FIG. 1, the individual cables 6*a, b* are each connected to a flexible guide part 7*a, b* of the head support ring 2. The opening is covered by padding covers 17 here which are arranged on an inner side of the outer shell 1 and is therefore not shown as such.

Figure 4:
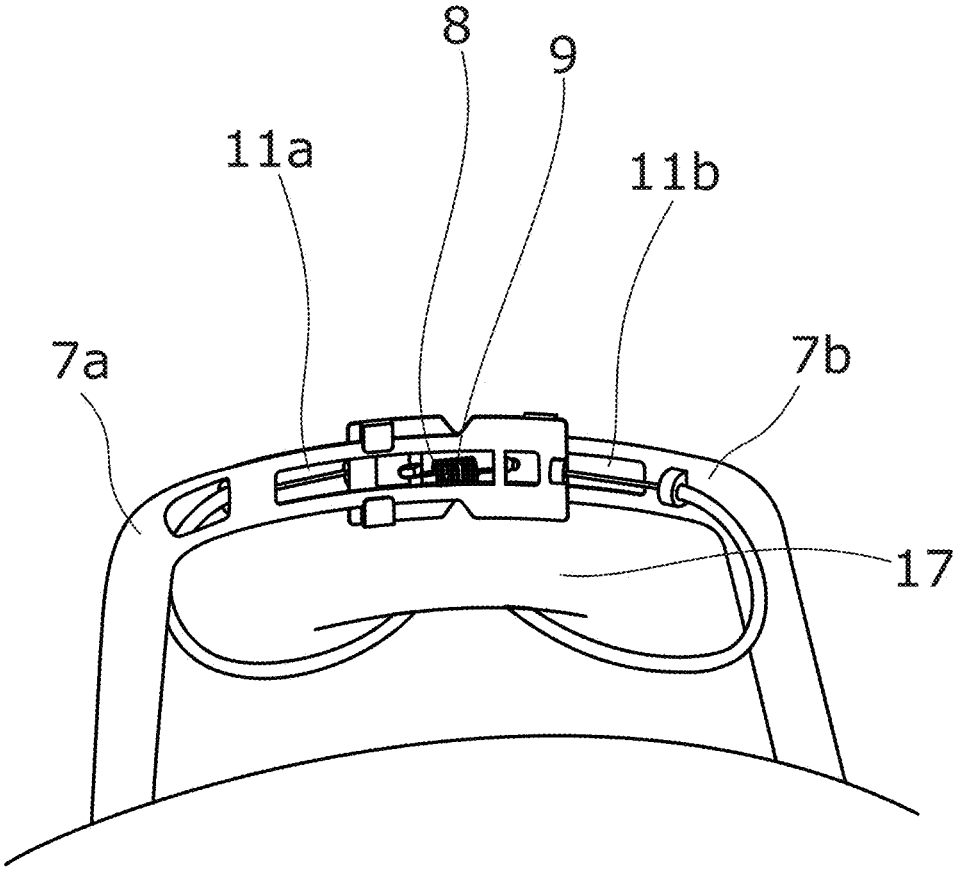
FIG. 4 shows a detailed view of the head support ring of the protective helmet from FIG. 1 in a basic state.

Turning the button 4 has the result that the guide parts 7*a, b* are displaced onto one another by the tensile force applied by the cable arrangement 5 consisting of the individual cables 6*a, b*. FIG. 4 shows a basic state of the guide parts 7*a, b* and therefore of the head support ring 2 which corresponds to a maximum circumference of the head support ring 2. This maximum circumference of the head support ring here forms a basic circumference. A spring device 8 consisting of a tension spring 9 is clearly fastened to the guide parts 7*a, b*. In this state with the maximum circumference of the head support ring 2 the spring device already has a pre-tension. This pre-tension acts to transfer the circumference of the head support ring 2 into the basic circumference or to leave the circumference of the head support ring 2 in the basic circumference.

Figure 5:
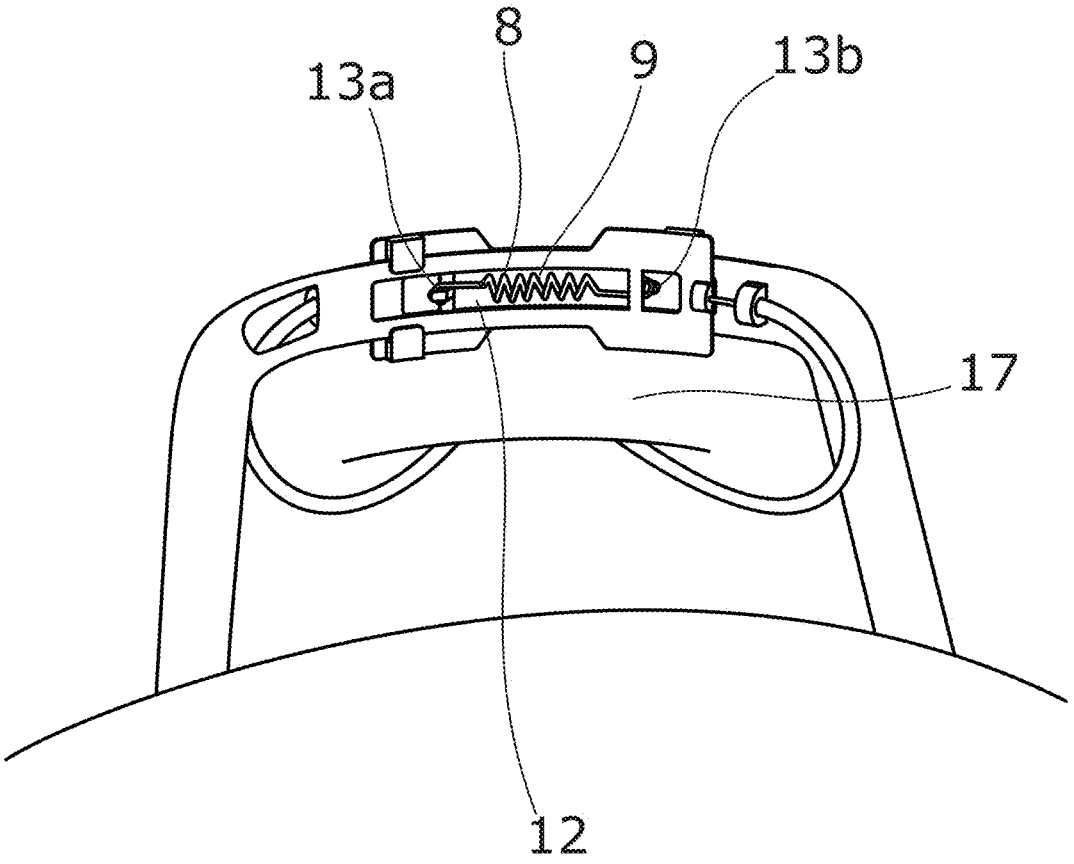
FIG. 5 shows a detailed view of the head support ring of the protective helmet from FIG. 1 in the state with a reduced circumference and FIG. 6 shows an inner view of the protective helmet from FIG. 1 in a schematic diagram in sectional view with the padded covers removed.

On the other hand, in the diagram of FIG. 5 the guide parts 7*a, b* are already displaced onto one another by means of the tensile actuation just described by means of the cable arrangement 5 in such a manner that starting from the basic state, the circumference of the head support ring 2 was reduced. It can be seen that the tensile forces applied by the individual cables 6*a, b* in each case are directed substantially opposite in their direction.

The displacement of the guide parts 7*a, b* and the reduction of the circumference of the head support ring 2 has also had the result that the spring device 8 is further tensioned. This further tension—in the same way as the pre-tension already present in the basic state—acts in the direction of a displacement of the guide parts 7*a, b* back into the basic state with the maximum circumference, i.e. with the basic circumference.

The guide parts 7*a, b* clearly have a respective guide opening 11*a, b* which are aligned with one another and form a complete opening 12. The size of the complete opening 12 clearly depends on how far the guide parts 7*a, b* are displaced onto one another. It can be seen from FIGS. 4 and 5 that in the state with the reduced circumference of the head support ring 2 the area of the complete opening 12 is greater than in the basic state as a result of the higher degree of overlap of the guide parts 7*a, b*.

The spring device 8 consisting of the tension spring 9 is connected to the guide parts 7*a, b* at fastening points 13*a, b* of the cable arrangement 5 with the guide parts 7*a, b* and therefore in the region of the respective guide opening 11*a, b*. The spring device 8 is therefore arranged substantially inside the complete opening 12.

The cable arrangement 5 is released by a pressure actuation of the button 4. The pre-tension of the spring device 8 brings about an almost simultaneous return into the state shown in FIG. 4 in which the circumference of the head support ring 2 again corresponds to the basic circumference.

It can be seen from FIG. 2 that in addition to the outer shell 1 the protective helmet firstly also has another neck protector 14 arranged in the vertical direction underneath the outer shell 1, whose inner side can also be seen in FIG. 3. It can be seen that the guide parts 7*a, b* are arranged vertically offset with respect to the outer shell 1 and therefore in the region of the neck protector 14.

Secondly the protective helmet also has an inner layer part 16 which is shown in FIG. 6. In the view in FIG. 6 the padded covers 17 which normally and as shown in FIG. 3 cover both the inner layer part 16 and also substantial parts of the guide parts 7*a, b* are partially removed.

In addition to the guide parts 7*a, b* the head support ring 2 consists of a main section 18 whose central part 19 is firmly connected to the inner layer part 16 and whose arms 20*a, b* are connected to the guide parts 7*a, b*.

The invention claimed is:

1. A protective helmet comprising: an outer shell for distributing impact forces, a head support ring for placing on a head of a wearer of the protective helmet, and an adjustment device for adjusting a circumference of the head support ring for adapting to the head of the wearer, wherein the adjustment device is guided through at least one opening of the outer shell for operation from outside the outer shell, wherein the adjustment device is adapted to tension a spring device of the protective helmet during adjustment of the circumference such that the tension of the spring device acts to transfer the circumference of the head support ring into a basic circumference, wherein the basic circumference of the head support ring corresponds to a maximum circumference of the head support ring wherein a reduction of the circumference of the head support ring starting from the maximum circumference produces a tension of the spring device which tension acts in the direction of a return to the maximum circumference, wherein the head support ring has two flexible guide parts adapted to be displaced onto one another for adjusting the circumference of the head support ring, wherein the spring device is connected to the guide parts and is adapted to apply a tension of the spring device as spring force to the guide parts, wherein the spring device has a tensile load spring for applying the spring force to the guide parts.

2. The protective helmet according to claim 1, wherein the adjustment device has a button for adjusting the circumference by a rotary movement, which button is configured to be turned from outside the outer shell, wherein the button is guided through the at least one opening.

3. The protective helmet according to claim 1, wherein the at least one opening is a bore completely surrounded by the outer shell, wherein the at least one opening is arranged on a rear side of the outer shell.

4. The protective helmet according to claim 1, wherein the adjustment device comprises a cable arrangement, coupled to the button, wherein the cable arrangement is adapted to apply a pulling actuation to the head support ring for adjusting the circumference, by a turning of the button.

5. The protective helmet according to claim 4, wherein the adjustment device is adapted to reduce the cable length of the cable arrangement by winding up the cable arrangement to adjust the circumference of the head support ring.

6. The protective helmet according to claim 4, wherein the cable arrangement is guided through the at least one opening, the button is arranged outside the outer shell.

7. The protective helmet according to claim 1, wherein the guide parts form at least partially the circumference of the head support ring.

8. The protective helmet according to claim 7, wherein the adjustment device, is adapted to displace the guide parts onto one another for adjusting the circumference, wherein the guide parts have a respective guide opening, wherein the guide openings align at least partially with one another and thereby form a complete opening, wherein the area of the complete opening is adapted by adjusting the circumference of the head support ring.

9. The protective helmet according to claim 8, wherein the spring device is arranged substantially at the complete opening.

10. The protective helmet according to claim 7, wherein the adjustment device, the cable arrangement is adapted to apply a substantially oppositely directed tensile force to the guide parts in each case to adjust the circumference of the head support ring, wherein the spring device is arranged between fastening points of the cable arrangement with the respective guide part.

11. The protective helmet according to claim 1, wherein the protective helmet has a neck protector to substantially completely cover a neck of the wearer, which neck protector is arranged at a lower edge of the outer shell, wherein the guide parts are offset in the vertical direction with respect to the outer shell and are arranged such that the guide parts are covered by the neck protector.

12. The protective helmet according to claim 1, wherein the adjustment device is adapted to be released by a release actuation so that as a result of its pre-tension the spring device transfers the head support ring into the basic circumference, wherein the release actuation comprises a pressure actuation.

13. The protective helmet according to claim 1, wherein the protective helmet has at least one inner layer part received by the outer shell for damping impact forces and that the head support ring has a main section for fastening the head support ring to the at least one inner layer part, wherein the at least one inner layer part is arranged in a fixed position with respect to the outer shell.

14. The protective helmet according to claim 13, wherein the main section is connected to the at least one inner layer part such that the at least one inner layer part maintains its position with respect to the outer shell upon an adjustment of the circumference of the head support ring.

15. The protective helmet according to claim 13, wherein the main section is substantially T-shaped with two elongate and oppositely running arms for fastening to a respective guide part and with an elongate central part for fastening in a central region of the outer shell, wherein the arms run substantially along a side edge of the outer shell, wherein the central part runs substantially along a crest line of the outer shell.

* * * * *